United States Patent [19]

Venter

[11] 4,191,227

[45] Mar. 4, 1980

[54] ATTACHMENT FOR A POWER TOOL

[75] Inventor: Daniel J. J. Venter, Pretoria, South Africa

[73] Assignee: Knipping (Proprietary) Limited, Johannesburg, South Africa

[21] Appl. No.: 900,877

[22] Filed: Apr. 28, 1978

[30] Foreign Application Priority Data

May 4, 1977 [ZA] South Africa ..... 77/2680

[51] Int. Cl.[2] ..... B25B 23/10

[52] U.S. Cl. ..... 145/46; 145/1 R; 145/50 D

[58] Field of Search ..... 144/32; 145/46, 50 B, 145/50 D, 1 R, 1 B; 227/119, 139, 140; 269/100, 321 S

[56] References Cited

U.S. PATENT DOCUMENTS

| | | | |
|---|---|---|---|
| 874,613 | 12/1907 | McColm | 145/46 |
| 994,354 | 6/1911 | Winter | 227/119 |
| 2,191,010 | 2/1940 | Dahlquist | 145/1 R |
| 3,490,677 | 1/1970 | Pezza | 145/46 |

FOREIGN PATENT DOCUMENTS

| | | | |
|---|---|---|---|
| 2442445 | 4/1975 | Fed. Rep. of Germany | 269/100 |

*Primary Examiner*—Gary L. Smith

[57] ABSTRACT

An attachment for a power tool which permits a fastener being driven-in by the power tool to be held in a stable condition. The attachment includes a channel with an aperture in the web. The nose of the power tool fits in this aperture and can be secured therein. Each flange of the channel has a slot therein and a slide element passes through these aligned slots. The slide element has a keyhole opening therein formed by an aperture and a contiguous slot. The aperture is dimensioned to permit the head of a fastener to pass therethrough and the slot is dimensioned to receive the shank of the fastener. The head of the fastener cannot pass through the slot. By moving the slide element either the slot or the aperture therein can be aligned with the aperture in the web. A spacer can be provided for engaging the surface into which the fastener is to be driven. The spacer can be adjustable in position with respect to the channel.

14 Claims, 7 Drawing Figures

ATTACHMENT FOR A POWER TOOL

This invention relates to an attachment for an electric tool.

BACKGROUND TO THE INVENTION

To assist in securing corrugated or other roofing sheets to an underlying structure, screw threaded fasteners with sealing washers have been developed as have special electric power tools which are usually referred to simply as "screw drivers". Such screw drivers include a clutch which is engaged by the action of pressing the socket at the free end of the drive shaft against the head of the fastener. The socket is within a nose piece which can be adjusted with respect to the body of the tool in the direction of the axis of the power shaft. The nose piece abuts the roofing sheet as the fastener approaches its fully driven-in condition and the drilling pressure exerted is transferred from the fastener to the nose piece. As soon as this happens, the clutch disengages as the requisite force to hold it engaged is no longer present. In practice, the fastener advances slightly after the nose piece abuts the roofing sheet. If the nose piece has been correctly set, and the roofing sheet is standard insofar as the manner in which it deforms when the nose piece engages it is concerned, then the fasteners will be properly secured as the clutch will disengage at the right moment. However, setting the clutch accurately is extremely difficult and roofing sheets vary very substantially in characteristics. Furthermore, the nose piece is small and thus drilling pressure acts on a small area of the roofing sheet. Invariably, therefore, some of the fasteners on the roof tend to be overdrilled. This is because either the clutch did not disengage at the right moment, but remained engaged for too long, or the roofing sheet gave more than expected. The result is a depressed area around the fastener which can fill with water and cause costly leaks. To compensate for this an experienced worker sometimes judges what the characteristics of the sheet are and stops his tool before the clutch disengages. This, if not correctly and carefully done, results in under-drilling which means that the fastener is loose and not properly sealed.

The problems set forth above are particularly severe when the sheet is fastened through its ridges and not through its valleys. This is done in hot climates to permit greater freedom of distortion during sudden temperature changes. Fasteners driven through the sheet valleys tend to shear-off if the sheets are subjected to great temperature changes.

A further difficulty is that the fasteners are usually quite long, for example, 50 or 75 mm. With a conventional screw driver the fasteners are only held at their head end and, immediately pressure is applied, they tend to tilt over about their point of contact with the roofing sheet. Thus, it is difficult to guide the fastener and considerable skill is required on the part of the operator.

The present invention provides an attachment which overcomes, or at least minimises, both these difficulties.

BROAD DESCRIPTION OF INVENTION

According to the present invention there is provided an attachment for an electric power tool, the attachment comprising a member having a formation for receiving a nose of a power tool, means for securing the attachment to the power tool, a movable element having an opening therein, the opening comprising a contiguous slot and an aperture, and means for guiding said element between a position in which the aperture thereof is aligned with said formation of said member and a position in which said slot is aligned with said formation of said member.

Said element is preferably guided for sliding movement between said positions. In this form means for guiding comprises spaced, aligned slots through which said element passes.

The attachment can include a spacer for engaging a surface against which the attachment is placed, the position of said spacer with respect to said formation being adjustable.

In a specific form the attachment includes a channel having a web and two flanges, said formation being an aperture in said web. There can be a slot in each of said flanges, said element passing through said slots and being slidable in said slots.

An attachment of the form defined in the preceding paragraph can include a U-shaped spacer, said element being between said web and said spacer and the spacer being movable towards and away from said web.

BRIEF DESCRIPTION OF DRAWINGS

For a better understanding of the present invention, and to show how the same may be carried into effect, reference will now be made, by way of example, to the accompanying drawing, in which.

DETAILED DESCRIPTION OF INVENTION

Figure 1:
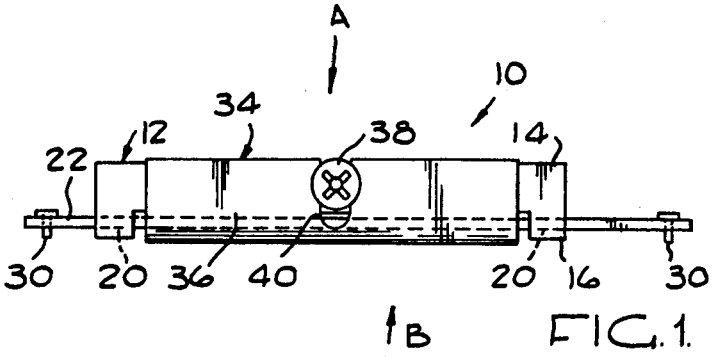
FIG. 1 is a side elevation of an attachment for a power tool.
Figure 2:
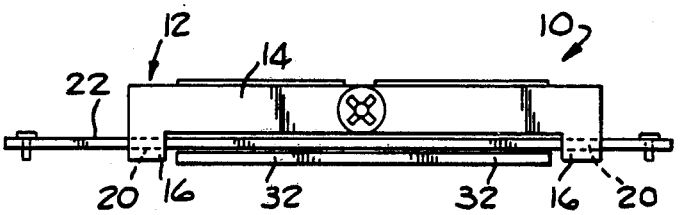
FIG. 2 is an elevation of the attachment from the opposite side.

The attachment 10 comprises a channel-shaped member 12 having a web 14 and two short flanges 16. The web 14 has a central, circular aperture 18 therein (see FIG. 4). Slots 20 are provided in the flanges 16 and a slide element 22 passes through these slots. The element 22, which is in the form of a flat bar, has a key-hole opening 24 therein, the opening comprising a slot 26 and an aperture 28. The slot 26 forms a continuation of the aperture 28.

Figure 3:
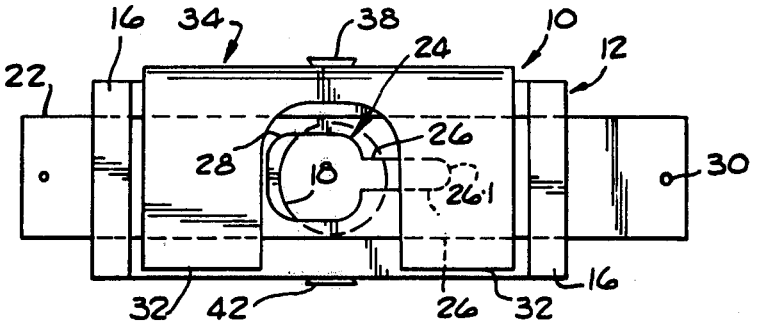
FIG. 3 is a view taken in the direction of the arrow B in FIG. 1.
Figure 7:
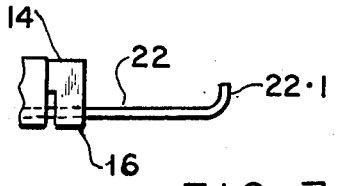
FIG. 7 is a detail of a modification of the attachment.

As will clearly be seen from FIG. 3, the key-hole opening 24 is provided in that portion of the element 22 which is between the flanges 16. The two portions of the element 22 which are beyond the flanges 16 each carry a small screw 30 which acts as a stop by engaging the outer face of the adjacent flange. A projecting rim 22.1 (FIG. 7) can be provided at one or both ends of the element 22. If provided these rims replace the screws 30 and also facilitate sliding of the element by the user.

The element 22 lies between the web 14 and the two limbs 32 of a U-shaped spacer 34. The portion 36 of the spacer which joins the limbs 32 is bent-over and secured by a screw 38 to the web 14. The screw 38 passes through an elongated slot 40 in the portion 36. This permits the position of the spacer to be altered thereby to vary the position of the exposed faces of the limbs 32 with respect to the end faces of the flanges 16. The spacer 34 is optional and can be omitted if desired.

A screw 42 passes through a tapped hole in the web 14, this hole intersecting the aperture 18.

Figure 5:
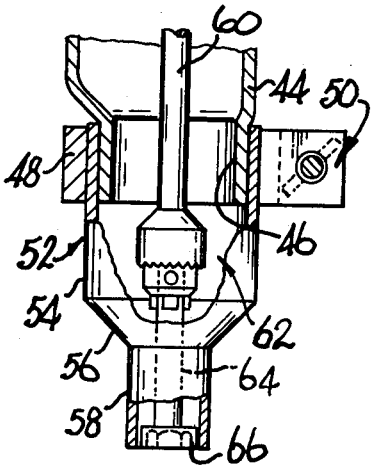
FIG. 5 illustrates the attachment connected to an electric power tool.

Turning now to FIG. 5, this illustrates the front end of an electric power tool of a type which does not include a slipping clutch. Part of the body of the tool is shown at 44, this part including a cylindrical sleeve 46. A split collar 48 encircles the sleeve 46 and a bolt and wing nut assembly 50 enables the collar 48 to be closed around the sleeve 46.

An adaptor 52 is provided which includes a sleeve 54, a cone 56 and tubular nose 58. The sleeve 46 fits into the sleeve 54. It will be seen that, by tightening the wing nut of the assembly 50, the collar 48 can be tightened onto the sleeve 54 thereby clamping it around the sleeve 46.

The rotatable shaft of the tool is diagrammatically shown at 60. The free end of the shaft terminates in a Jacobs chuck 62. An adaptor 64 has one end gripped by the chuck 62 and has at its other end a hexagonal socket 66.

The external diameter of the nose 58 is such that it fits the aperture 18. Once entered in this aperture the attachment 10 is clamped to the nose 58 by tightening the screw 42.

Figure 6:
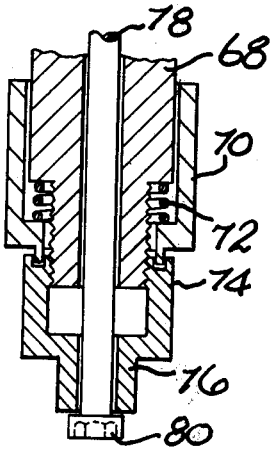
FIG. 6 illustrates the attachment connected to a further type of electric power tool.

In FIG. 6 there is shown part of a power tool which is specifically designed to drive in screws. The body of the power tool includes a cylindrical spigot 68 which is formed with external splines (not shown). A ring 70 encircles the spigot 68 and is internally grooved to receive the splines. Thus the ring 70 cannot rotate but is movable axially of the spigot 68. A coil spring 72 urges the ring 70 towards the free end of the spigot 68 and there are stops for limiting such movement of the ring.

An adaptor 74 is screwed onto the spigot 68, this including a nose 76 which is adapted to fit the aperture 18.

The end of the adaptor 74 remote from the nose 76, that is, the end against which the ring 70 abuts, is formed with recesses and the ring 70 is formed with mating teeth. To permit the position of the adaptor 74 to be adjusted along the spigot 68, the ring 70 is displaced away from the adaptor 74 against its biasing spring 72 and the adaptor 74 is then rotated. Once the adaptor has reached the required position, the ring 70 is released. Its biassing spring 72 then urges it back into engagement with the adaptor 74. The teeth and recesses provided interlock and further rotation of the adaptor is prevented.

A power shaft is diagrammatically shown at 78, this terminating in an hexagonal socket 80. The act of pushing the shaft 80 into the body of the tool engages the slip clutch of the tool.

Various forms of fastener of the screw and of the self-drilling type are commercially available. Use of the attachment in relation to self-drilling fasteners of the "Teks" type will be described initially and thereafter reference will be made to other forms of fasteners.

The "Teks" fastener includes an integral hexagonal head and shank and a sealing washer which can slide freely along the shank. The sealing washer itself comprises a metal disc to which is adhered a resilient disc.

Figure 4:
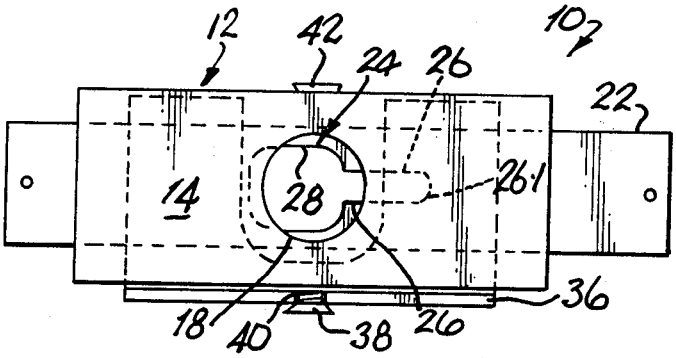
FIG. 4 is a view taken in the direction of the arrow A in FIG. 1.

In use of the attachment, the nose 58 or 76 is entered in the aperture 18 of the web 14 (from above as viewed in FIG. 4). The screw 42 is then tightened to secure the attachment to the power tool.

The slide element 22 is then slid to the extreme right hand position thereof (see particularly FIG. 3) so that the aperture 28 is aligned with the aperture 18. The nut-like head of a 'Teks' fastener is passed from below through the aperture 28 so that it lies in the aperture 18. The head is thus above the slide element 22 and in the aperture 18 where it is engaged with the socket 62 of the power tool.

The slide element 22 is then slid to the left so that the portion of the shank of the fastener which is between the head and the sealing washer enters the slot 26. In this condition the curved end face 26.1 of the slot is co-axial with the aperture 18 and the sealing washer lies below the element 22, as viewed in FIG. 1.

If the tool has a clutch then this is pre-adjusted (by displacing the adaptor 74 on the spigot 68) so that the action of so moving the slide element 22, which in turn moves the head of the fastener upwardly as illustrated in FIG. 6, engages the clutch.

The tip of the fastener is then placed against the surface to be drilled and drilling pressure exerted on the fastener by way of the hand grips of the power tool. Normally said surface is the upper surface of a ridge of a roofing sheet but could be the bottom of a valley between two ridges where side cladding is being secured.

It will be understood that the fastener is held at two spaced points along its length. Firstly its head is held by said socket and, at a point along its shank, movement thereof is restricted by the slot 26. Thus the tendency of the fastener to tilt when drilling pressure is applied thereto is minimised.

The slide element is moved back to the position in which its aperture 28 is aligned with the aperture 18 before the final stages of drilling and securing the fastener are reached. In fact, the slide element can be moved back as soon as the fastener has penetrated sufficiently far to stabilize it and render the supporting action of the slide element unnecessary.

As drilling progresses, the flanges 16 and limbs 32 move towards said ridge (or the bottom of the valley) and, eventually, engage said ridge or valley bottom. This limits further forward movement of the power tool and, during the short period of further rotation which follows, the fastener moves away from the tool. If the tool does not have a clutch as in the arrangement of FIG. 5, the fastener is rotated until its forward motion disengages its head from the socket 66 which cannot move further although the power tool is still in rotary motion. Experience gained in using the type of tool illustrated in FIG. 6 has shown that, when the described attachment is employed, the tool operates in generally the same way as a clutchless tool. More specifically, the fastener advances sufficiently far for it to disengage from the hexagonal socket, insofar as the transmission of drive thereto is concerned, without, however, permitting the clutch to disengage. Thus, with both types of tool, the fastener ceases to advance but the drive shaft and socket can still be driven.

Restriction of forward movement of the power tool upon engagement of the limbs 32 with the surface being drilled prevents overdrilling. Overdrilling is a particular problem where the fasteners are being used to secure roofing sheets to an underlying structure as it results in the creation of depressions in the portions of the roofing sheet surrounding the fastening elements. These depressions fill with water during rainy conditions and, as a result, leakage along the shanks of the fasteners can occur.

Where screw-type fasteners are used, overtightening is a problem and can cause similar undesirable results. Use of the described attachment, particularly where the tool has a slipping clutch, can avoid these results.

Not all commercially available fasteners have hexagonal heads. For example, fasteners with Phillips style heads are used. To use these fasteners, an appropriate screw-driver head must be used in place of the socket 66.

I claim:

1. An attachment for an electric power tool, the attachment comprising a member having a formation for receiving a nose of a power tool, means for securing the attachment to the power tool, a movable element having an opening therein, the opening comprising a contiguous slot and an aperture, means for guiding said element between a position in which the aperture thereof is aligned with said formation of said member and a position in which said slot is aligned with said formation of said member, and a spacer for engaging a surface against which the attachment is placed, the position of said spacer with respect to said formation being adjustable.

2. An attachment as claimed in claim 1, wherein said element is guided for sliding movement between said positions.

3. An attachment as claimed in claim 2, wherein said means for guiding comprises spaced, aligned slots through which said element passes.

4. An attachment as claimed in claim 1, in which said member is a channel having a web and two flanges, said formation being an aperture in said web.

5. An attachment as claimed in claim 4, wherein there is a slot in each of said flanges, said element passing through said slots and being slidable in said slots.

6. An attachment as claimed in claim 5, wherein said element protrudes in both directions beyond said flanges and the protruding portions carry stop means to limit movement of said element.

7. An attachment as claimed in claim 6, wherein said element has a projecting rim at least at one end thereof.

8. An attachment as claimed in claim 4, wherein said spacer is U-shaped, said element being between said web and said spacer and the spacer being movable towards and away from said web.

9. An attachment for an electric power tool, the attachment comprising a member having a formation for receiving a nose of a power tool, means for securing the attachment to the power tool, a movable element parallel to said member and having an opening therein, the opening comprising a contiguous slot and an aperture, and means for guiding said element between a position in which the aperture thereof is aligned with said formation of said member and a position in which said slot is aligned with said formation of said member.

10. An attachment as claimed in claim 9 in which said member is a channel having a web and two flanges, said formation being an aperture in said web and said element being parallel to said web.

11. An attachment as claimed in claim 10, wherein there is a slot in each of said flanges, said element passing through said slots and being slidable in said slots.

12. An attachment for a hand-held power tool, the attachment comprising a member having an aperture for receiving the nose of a power tool, a hole intersecting said aperture, a fastening element in said hole for permitting said attachment to be secured to a power tool nose entered in said aperture, a movable element having an opening therein, the opening comprising a contiguous slot and an aperture, and means for guiding said element between a position in which the aperture thereof is aligned with said formation of said member and a position in which said slot is aligned with said formation of said member.

13. An attachment as claimed in claim 12, wherein said hole is tapped and said fastening element is a screw.

14. The combination of a hand-held electric power tool and an attachment for the power tool, the power tool having a nose and the attachment comprising a member having an aperture in which the nose of the power tool is entered, means securing the attachment to said nose, a movable element parallel to said member and having an opening therein, the opening comprising a contiguous slot and an aperture, and means for guiding said element between a position in which the aperture thereof is aligned with said aperture of said member and a position in which said slot is aligned with said aperture of said member.

* * * * *